US008425105B2

(12) United States Patent
Yang

(10) Patent No.: US 8,425,105 B2
(45) Date of Patent: Apr. 23, 2013

(54) NIGHTLIGHT HAVING A ROTATABLE PLUG

(76) Inventor: Wen-Yuan Yang, Hsinchu (TW)

( * ) Notice: Subject to any disclaimer, the term of this patent is extended or adjusted under 35 U.S.C. 154(b) by 0 days.

(21) Appl. No.: 13/213,170

(22) Filed: Aug. 19, 2011

(65) Prior Publication Data

US 2013/0044518 A1 Feb. 21, 2013

(51) Int. Cl.
*H01R 33/00* (2006.01)

(52) U.S. Cl.
USPC ..... 362/641

(58) Field of Classification Search ..... 362/640–641
See application file for complete search history.

(56) References Cited

U.S. PATENT DOCUMENTS 6,093,028 A * 7/2000 Yang ..... 439/13
6,648,496 B1 * 11/2003 Elghoroury et al. ..... 362/555
6,843,656 B2 * 1/2005 Hwang et al. ..... 439/11

* cited by examiner

*Primary Examiner* — Anh Mai
*Assistant Examiner* — Hana Featherly

(74) *Attorney, Agent, or Firm* — Rosenberg, Klein & Lee

(57) ABSTRACT

A nightlight comprises a body having a press button; a base arranged on the body and having a round engagement basin at a central region thereof; a rotatable plug arranged between the body and the base and including a round positioning engagement block arranged on a front side thereof and accommodated by the round engagement basin and two conductive insert plates penetrating the round positioning engagement block; and a light emitting element arranged in the body. The positioning engagement block is rotatably engaged with the engagement basin, whereby the rotatable plug can rotate with respect to the base by 360 degrees. Further, only the ends of the first and second conductive insert plates are exposed outsides, whereby is reduced the size of the nightlight and decreased the number of the components.

11 Claims, 4 Drawing Sheets

NIGHTLIGHT HAVING A ROTATABLE PLUG

BACKGROUND OF THE INVENTION

1. Field of the Invention

The present invention relates to a nightlight, particularly to a nightlight having a rotatable plug.

2. Description of the Related Art

A nightlight is turned on to replace ordinary lamps before sleep lest intense light interfere with sleep or rest. A nightlight provides a low-level illumination for the user to recognize the aisle and furniture when he gets up at midnight.

The conventional nightlight has a lamp body. A bulb is arranged in one side of the lamp body, and a plug with two parallel conductive plates is arranged in the other side. Normally, the relative position of the lamp body and the plug is fixed. Thus, the conventional nightlights are more suitable to the sockets having vertical insert slots. If the insert slots are arranged horizontally, the nightlight must be overturned by 90 degrees for installation, which would degrade esthetics of the interior. Besides, the cabinet or article may hinder the nightlight from being overturned.

A Taiwan patent of application No. 096201118 disclosed a nightlight with a rotatable plug to solve the abovementioned problem. However, the rotatable plug is entirely exposed outside the lamp body in the prior art. Thus, the conventional nightlight is somewhat bulky and has more components.

Accordingly, the present invention proposes a novel nightlight to overcome the problems of the conventional technologies.

SUMMARY OF THE INVENTION

The primary objective of the present invention is to provide a nightlight, wherein a positioning engagement block is arranged in an engagement groove to enable the rotatable plug to rotate by 360 degrees, and wherein most elements of the rotatable plug is concealed between the lamp body and the base with only the ends of the first and second conductive insert plates being revealed, wherefore the nightlight of the present invention has advantages of fewer components and reduced size.

To achieve the abovementioned objective, the present invention proposes a nightlight, which comprises a body having a press button; a base arranged on the body and having a round engagement groove; a rotatable plug arranged between the body and the base and having a round positioning engagement block protruding from the front thereof, able to rotate with respect to the base, and having two conductive insert plates penetrating the positioning engagement block; and a light emitting element arranged on the body, wherein the press button is used to determine the conduction state of the light emitting element and the conductive insert plates.

Below, the embodiments are described in detail in cooperation with the drawings to demonstrate the technical contents and efficacies of the present invention.

DETAILED DESCRIPTION OF THE INVENTION

Figure 1:
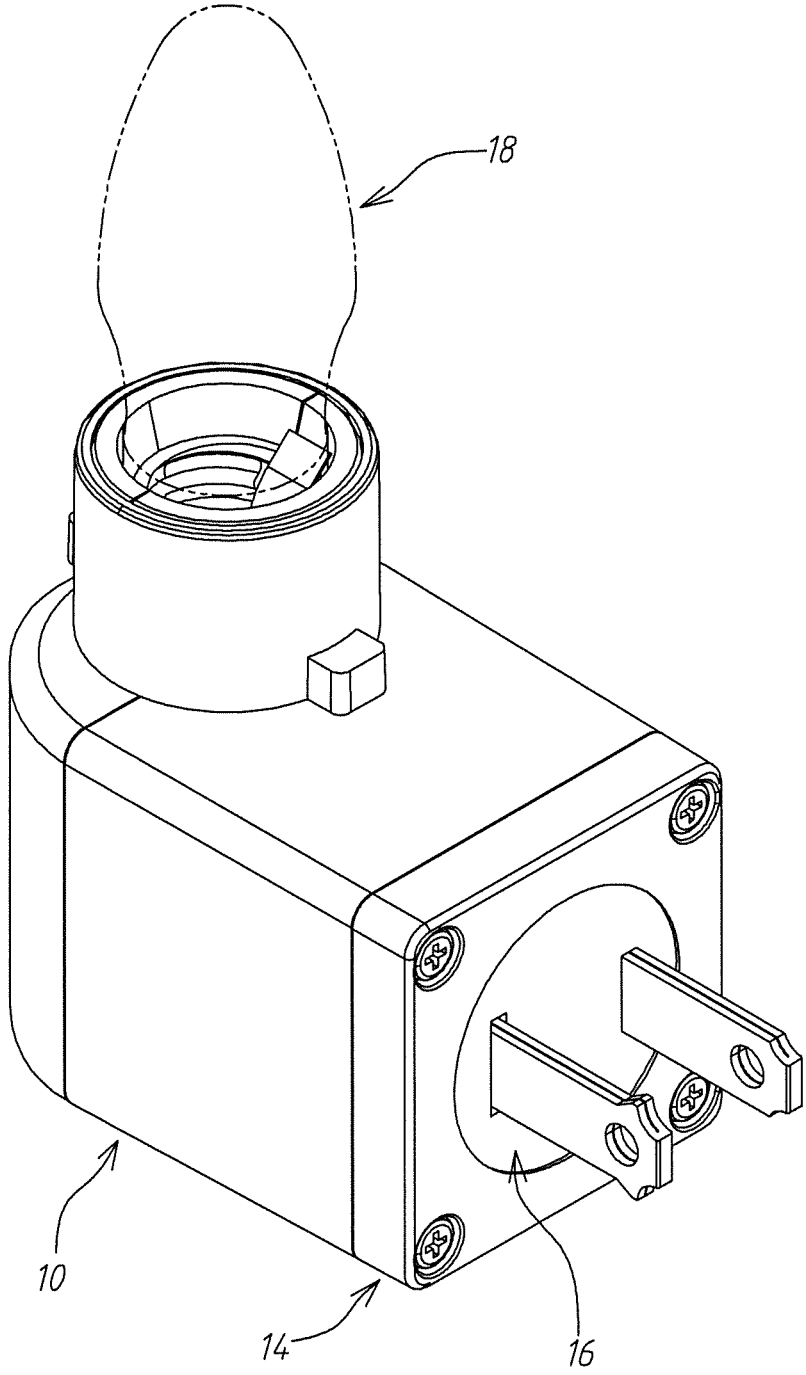
FIG. 1 is a perspective view of a nightlight according to one embodiment of the present invention
Figure 2:
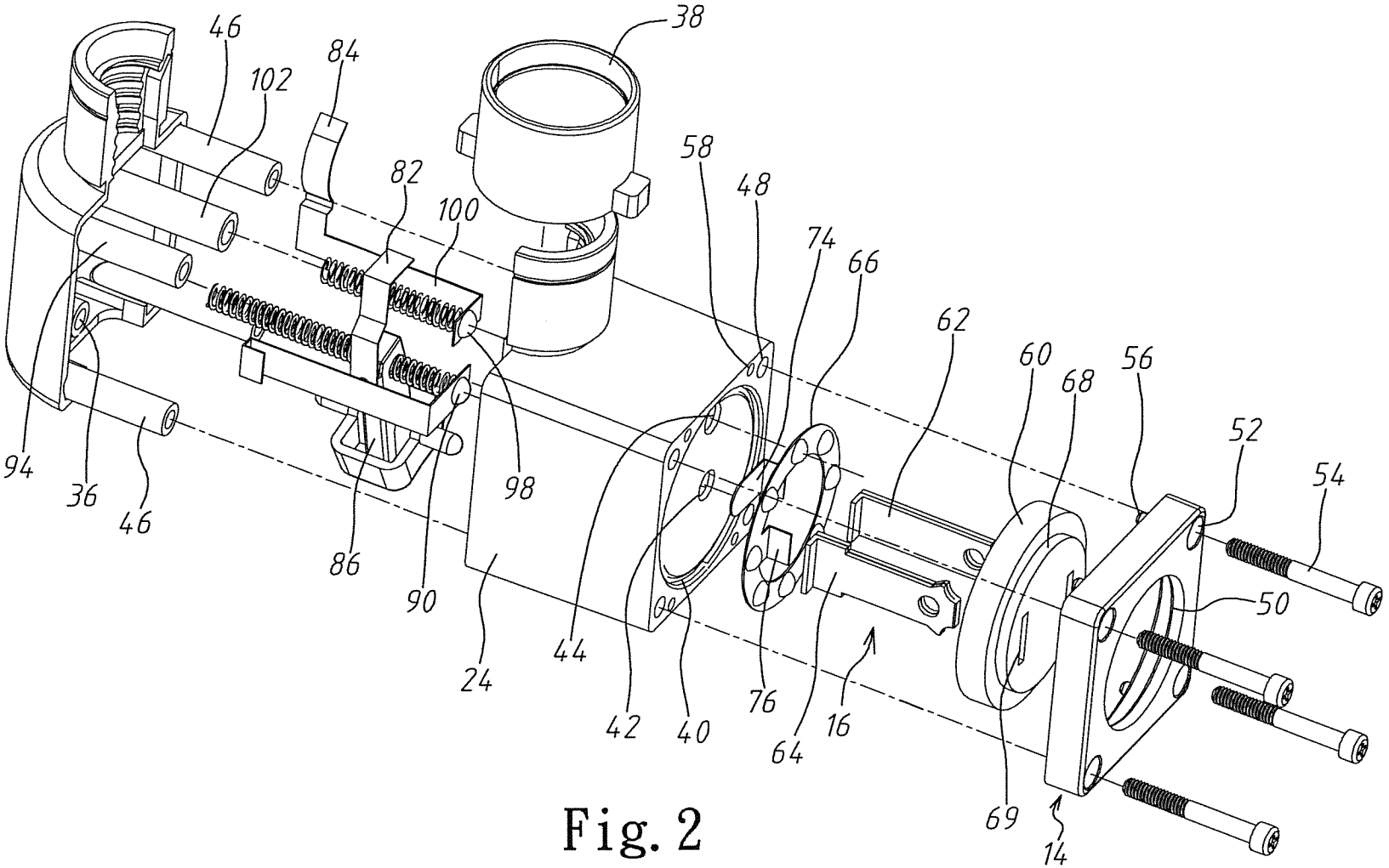
FIG. 2 is a first exploded view of a nightlight according to one embodiment of the present invention.
Figure 3:
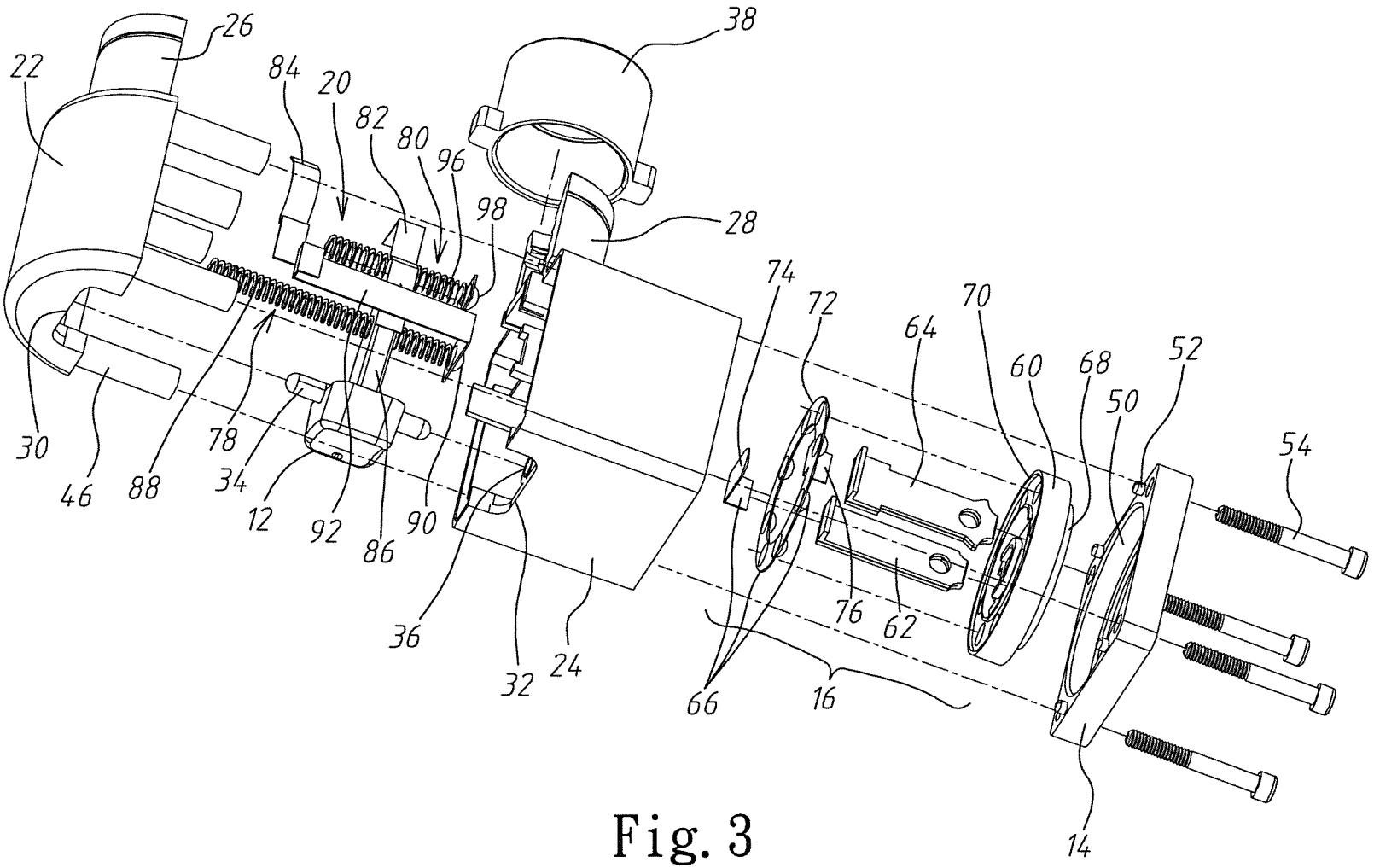
FIG. 3 is a second exploded view (taken from another view angle) of a nightlight according to one embodiment of the present invention.
Figure 4:
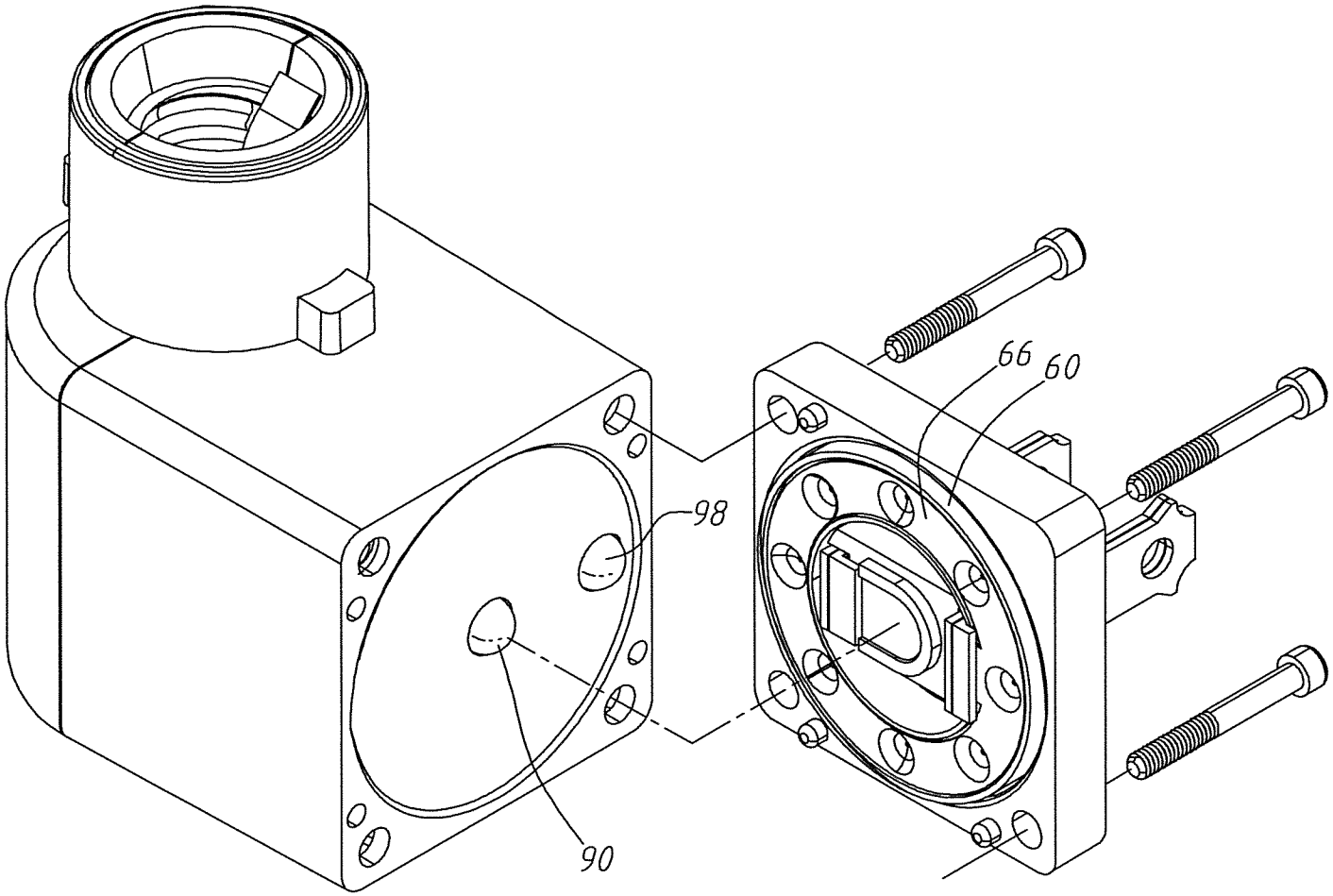
FIG. 4 is a local exploded view of a nightlight according to one embodiment of the present invention.

Refer to FIGS. 1-4 respectively a perspective view, a first exploded view, a second exploded view and a local exploded view of a nightlight according to one embodiment of the present invention.

The nightlight of the present invention comprises a body 10, a press button 12, a base 14, a rotatable plug 16, a light emitting element 18 and a switch unit 20.

The body 10 includes a first half-casing 22 and a second half-casing 24. The first half-casing 22 has a first lamp-seat half-basin 26 and a first button half-socket 30; the second half-casing 24 has a second lamp-seat half-basin 28 and a second button half-socket 32. The first half-casing 22 and the second half-casing 24 are assembled to each other to form the body 10 having a lamp-seat basin and a button socket. The light emitting element 18 is installed in the lamp-seat basin. The press button 12 is snap-fitted to the button socket. Refer to the drawings for the snap-fit mechanism of the press button 12. Two sides of the press button 12 respectively have snap-fit pillars 34. The first half-casing 22 and the second half-casing 24 respectively have snap-fit holes 36 corresponding to the snap-fit pillars 34. The lamp-seat basin is further sleeved by a shell 38 to reinforce the structure.

The surface of the second half-casing 24 has a recess 40; a first through-hole 42 and a second through-hole 44 are formed in the recess 40. The inner surface of the first half-casing 22 has several insert columns 46; the second half-casing 24 has several screw holes 48 corresponding to the insert columns 46.

The base 14 has a tapered round engagement basin 50 in the central region thereof and has several screw holes 52 in the perimeter thereof. Screws 54 are inserted through the screw holes 52 and the screw holes 48 and then fixed to the insert columns 46. Thereby, the base 14 is assembled to the body 10. The inner surface of the base 14 has several tenons 56; the outer surface of the second half-casing 24 has several mortises 58 corresponding to the tenons 56. Thereby, the base 14 can be aligned to the body 12 easily.

The rotatable plug 16 is arranged between the recess 40 of the second half-casing 24 and the base 14. The rotatable plug 16 includes a round insulating member 60, a first conductive insert plate 62, a second conductive insert plate 64 and a conductive ring 66. A round positioning engagement block 68 protrudes from the front side of the round insulating member 60 and has a diameter smaller than that of the round insulating member 60. Two insert slots 69 penetrate the round insulating member 60. The first conductive insert plate 62 and second conductive insert plate 64 are inserted through the insert slots 69 with the ends thereof protruding from the round positioning engagement block 68. The round positioning engagement block 68 is arranged inside the round engagement basin 50 to enable the rotatable plug 16 to rotate with respect to the base 14.

The other side of the insulating member 60 has an accommodation basin 70 whose shape is corresponding to the conductive ring 66. The insulating member 60 electrically insulates the conductive ring 66 from the exterior. The conductive ring 66 includes a ring body 72, a first bracing plate 74 not joined to the ring body 72, and a second bracing plate 76 joined to the ring body 72. The first bracing plate 74 electrically connects with the first conductive insert plate 62, and the second bracing plate 76 electrically connects with the second conductive insert plate 64.

The switch unit 20 includes a first trigger element 78, a second trigger element 80, a first elastic plate 82 and a second elastic plate 84. The first trigger element 78 has a first elastic element 88 penetrating an extension member 86 formed in the inner surface of the press button 12 and a first conductive plate 92 having a first conductive protrusion 90 at the front thereof. One end of the first elastic element 88 presses against a convex column 94 inside the first half-casing 22, and the other end of the first elastic element 88 presses against the first conductive plate 92, whereby the first conductive protrusion 90 passes through the first through-hole 42 to contact the first bracing plate 74.

The second trigger element 80 has a second elastic element 96 and a second conductive plate 100 having a second conductive protrusion 98 at the front thereof. One end of the second conductive plate 100 is fabricated into the second elastic plate 84 extending to the inner wall of the lamp-seat basin. The first elastic plate 82 is arranged on the extension member 86, which extends from the inner surface of the press button 12, and extends to the bottom of the lamp-seat basin. One end of the second elastic element 96 presses against a convex column 102 inside the first half-casing 22, and the other end of the second elastic element 96 presses against the second conductive plate 100, whereby the second conductive protrusion 98 passes through the second through-hole 44 to contact the conductive ring 66 and then electrically connects with the second conductive insert plate 64 via the second bracing plate 76.

The first elastic plate 82 is arranged on the extension member 86 extending from the inner surface of the press button 12. The press button 12 is operated to determine whether the first elastic plate 82 contacts or separates from the first conductive plate 92 of the first trigger element 78.

In conclusion, the present invention proposes a novel nightlight with a rotatable plug, wherein a positioning engagement block is rotatably engaged with an engagement basin, whereby the rotatable plug can rotate with respect to the seat by 360 degrees. Further, most of the elements of the rotatable plug are concealed between the seat and the body with only the ends of the first and second conductive insert plates exposed outsides, whereby is reduced the size of the nightlight and decreased the number of the components, wherefore the nightlight is easy to assemble and looks succinct.

The embodiments described above ore only to exemplify the present invention but not to limit the scope of the present invention. Any equivalent modification or variation according to the spirit of the present invention is to be also included within the scope of the present invention.

What is claimed is:

1. A nightlight comprising:

a body having a press button, said body including at least one displaceable coupling member exposed therethrough;

a base arranged on said body and having a round engagement basin at a central region thereof;

a rotatable plug arranged between said body and said base and including a round positioning engagement block arranged on a front side thereof and two conductive insert plates penetrating said round positioning engagement block, said rotatable plug including a conductive member defining a plurality of coupling portions offset one from the other in angular position about a rotation axis;

wherein said round positioning engagement block is moveably installed in said round engagement basin to enable said rotatable plug to rotate about the rotation axis with respect to said base between a plurality of releasably locked angular positions, said rotatable plug at each said angular position being releasably locked by one of said coupling portions thereof engaging said coupling member in resiliently biased manner; and a light emitting element arranged in said body, wherein said press button is used to control a conduction state of said light emitting element and said conductive insert plates.

2. The nightlight according to claim 1, wherein said body has several fixing holes, and wherein several fixing elements are inserted through perimeter of said base to engage with said fixing holes, fastening said base to said body.

3. The nightlight according to claim 1, wherein said fixing elements are screws, and wherein said fixing holes are screw holes.

4. The nightlight according to claim 1, wherein said body has several mortises, and wherein said base has several tenons engaged with said mortises.

5. The nightlight according to claim 1, wherein said body includes a first half-casing and a second half-casing, and wherein said first half-casing has a first lamp-seat half-basin and a first button half-socket, and wherein said second half-casing has a second lamp-seat half-basin and a second button half-socket, and wherein said first half-casing and said second half-casing are assembled to form a lamp-seat basin and a button socket.

6. The nightlight according to claim 1, wherein a shell sleeves said lamp-seat basin.

7. The nightlight according to claim 1, wherein said rotatable plug includes:

a round insulating member having said round positioning engagement block protruding from a front side thereof, wherein said conductive insert plates penetrate said round insulating member and protrude from said round positioning engagement block, said conductive member is arranged behind said round insulating member and includes a first bracing plate and a second bracing plate respectively contacting said two conductive insert plates.

8. The nightlight according to claim 7, wherein a switch unit is arranged inside said body and includes a first trigger element;

a second trigger element, wherein said first trigger element and said second trigger element respectively electrically connect with said two conductive insert plates; and a first elastic plate arranged on an extension member on an inner surface of said press button and operated by said press button to contact or separate from said first trigger element to control a conduction state of said light emitting element and said two conductive insert plates.

9. The nightlight according to claim 1, wherein said at least one displaceable coupling member terminates at a conductive protrusion displaceably emerging from said body.

10. The nightlight according to claim 9, wherein said coupling portions are recesses each configured to receive said conductive protrusion.

11. The nightlight according to claim 1, wherein said conductive member is contoured to substantially form a conductive ring.

* * * * *